US009096415B2

(12) United States Patent
Bleeker et al.

(10) Patent No.: US 9,096,415 B2
(45) Date of Patent: Aug. 4, 2015

(54) LIFTING DEVICE FOR SCISSOR LIFTS

(75) Inventors: Veronika Bleeker, Wildpoldsried (DE); Andreas Gartner, Lachen (DE); Thomas Grotzinger, Immenstadt (DE)

(73) Assignee: MAHA MASCHINENBAU HALDENWANG GMBH & CO. KG, Haldenwang (DE)

( * ) Notice: Subject to any disclaimer, the term of this patent is extended or adjusted under 35 U.S.C. 154(b) by 310 days.

(21) Appl. No.: 13/576,890

(22) PCT Filed: Jan. 21, 2011

(86) PCT No.: PCT/EP2011/000252
§ 371 (c)(1),
(2), (4) Date: Oct. 9, 2012

(87) PCT Pub. No.: WO2011/098209
PCT Pub. Date: Aug. 18, 2011

(65) Prior Publication Data

US 2013/0037765 A1 Feb. 14, 2013

(30) Foreign Application Priority Data

Feb. 9, 2010 (DE) ..... 10 2010 001 727

(51) Int. Cl.
*B66F 7/06* (2006.01)
*B66F 7/08* (2006.01)
*B66F 3/12* (2006.01)

(52) U.S. Cl.
CPC . *B66F 7/08* (2013.01); *B66F 7/065* (2013.01); *B66F 3/12* (2013.01)

(58) Field of Classification Search
USPC ..... 254/122
See application file for complete search history.

(56) References Cited

U.S. PATENT DOCUMENTS

| | | | | |
|---|---|---|---|---|
| 3,891,108 | A * | 6/1975 | Traficant | 254/45 |
| 4,546,592 | A * | 10/1985 | Reil | 53/373.6 |
| 4,858,888 | A * | 8/1989 | Cruz et al. | 254/122 |
| 5,192,053 | A * | 3/1993 | Sehlstedt | 254/122 |
| 5,322,143 | A * | 6/1994 | Curran | 187/211 |
| 6,464,205 | B2 * | 10/2002 | Wanner | 254/122 |
| 6,601,826 | B1 * | 8/2003 | Granata | 254/122 |
| 7,334,804 | B2 * | 2/2008 | Mitchell et al. | 280/79.4 |
| 8,469,152 | B2 * | 6/2013 | Olsen et al. | 187/211 |
| 2006/0126966 | A1 * | 6/2006 | Strege et al. | 382/289 |
| 2006/0279728 | A1 * | 12/2006 | Dorrance et al. | 356/139.03 |
| 2009/0078509 | A1 | 3/2009 | Olsen et al. | |

FOREIGN PATENT DOCUMENTS

| | | | |
|---|---|---|---|
| DE | 93 14 002 | U1 | 11/1993 |
| DE | 299 20 934 | U1 | 3/2000 |
| DE | 20 2004 013 362 | U1 | 11/2004 |
| GB | 2 267 695 | A | 12/1993 |
| WO | WO 01/27499 | A1 | 4/2001 |

OTHER PUBLICATIONS

International Search Report issued in International Patent Application No. PCT/EP2011/000252 dated Apr. 14, 2011.

* cited by examiner

*Primary Examiner* — Lee D Wilson
*Assistant Examiner* — Alvin Grant
(74) *Attorney, Agent, or Firm* — Oliff PLC

(57) ABSTRACT

A lifting device for scissor lifts, in particular for raising motor vehicles, which during the starting phase of the lifting movement requires a reduced force for raising. The lifting device for scissor lifts includes at least two scissor arms which cross one another, a linear actuator for raising a scissor arm, a double lever joint which is pivotably mounted on a scissor arm; wherein the double lever joint couples the lifting movement of the linear actuator to at least one scissor arm.

10 Claims, 4 Drawing Sheets

LIFTING DEVICE FOR SCISSOR LIFTS

The present invention relates to a lifting device for scissor lifts, in particular for raising motor vehicles, which requires a reduced force for lifting in the starting phase of the lifting movement and produces a low mechanical load of the set-up components. In addition, the scissor lift has a compact construction in the retracted position.

Scissor lifts are used in different technical fields for raising various loads and optionally also persons. Different configurations of scissor lifts are also employed for raising motor vehicles, in particular passenger cars, sport utility vehicles and transporters, in repair shops, in manufacturing factories and also in examination shops, namely due to the simple lifting technology, the robust construction and the possibility of ground level arrangement of the retracted scissor lift.

For the construction of the lifting mechanism, at least two congruent scissors are used. If particularly large heights are to be reachable, thus, multiple such scissor pairs can be disposed one above the other, whereby for example double scissor lifts or multiple scissor lifts result.

In the lowered state, scissor lifts are to have a construction height as low as possible in order to facilitate application of the loads to be lifted in this position. In particular the lifts for motor vehicles are to protrude as little as possible beyond the ground surface in their lowered position in order to thus facilitate the drive-on of the motor vehicles. Therein, furthermore, a particular mounting pit on the installation place can also be omitted.

However, herein, problems arise in the scissor lifts that the scissor arms pivotable with respect to each other have to be parallel next to each other as possible in the lowered state of the scissor lift for reasons of space, whereby unfavorable lever geometries for the lifting devices arise in the starting phase of the lifting movement.

Generally, it applies that the more distant the working point of the lifting cylinder on the supporting place of the scissor arm is from the associated pivot point and the closer the angle between the longitudinal axes of the scissor arms and the lifting cylinder is to 90°, the more advantageous the leverage ratio becomes, and as a result, the required forces for extending the lifting cylinder decrease.

In a known double scissor lift, bearings for hinged connection of a lower scissor and an upper scissor of a base frame side are each located at the adjoining ends of the scissor arms formed as linear supports. Upon lowering the platform, therefore, the scissor arms cannot move into the completely horizontal position because the bearings each rest on the tops of the scissor arms of the lower scissor. Thus, the scissor arms remain in a slight inclination, whereby the minimum height of the platform in the lowered state, that is the construction height, is determined.

A further problem results from it, namely that more unfavorable lever effect ratios for the lifting cylinder(s) arise with decreasing lifting height such that for lifting the lifting table or the same load reception of a lift from its lowered position, multiple times higher compression forces for the lifting cylinder(s) are required compared to the nominal load. Therefore, conventional scissor lifts cannot be further retracted than up to a lower position, in which the lifting cylinder engaging on the lift still has an angle of attack of few angular degrees.

DE 299209 34 U1 shows a set-up mechanism for a scissor lift, which allows a larger angle between lifting cylinder and scissor arm and thereby a more beneficial lever attack ratio and easier set-up of the scissor lift by means of a spreading lever, two rolling bodies and a stop plate. However, the shape of the spreading lever shown in DE 299209 34 U1 results in a high material strain, in particular in the regions in contact with the stop plate. This results in high material stress or high mechanical loading and requires comparatively expensive manufacture in connection with the roller bearings. A further disadvantage is the noise development that the spreading lever generates on the stop plate.

Therefore, it is an object of the present invention to provide a lifting device for a scissor lift, which reduces the forces required in the starting phase of the lifting movement and which allows a compact construction of the scissor lift in the lowered state. A further object of the present invention is to realize the lifting device with inexpensive components, which allows low-noise raise.

This object is solved by a lifting device according to the features of claim 1. The dependent claims relate to advantageous developments of the invention.

According to the invention, the lifting device for scissor lifts includes at least two scissor arms crossing each other, a linear actuator for lifting the scissor arms, a double lever joint, which is pivotably mounted on a scissor arm, wherein the double lever joint couples the lifting movement of the linear actuator to at least one scissor arm. Therein, the double lever joint allows a particularly advantageous leverage ratio in lifting a scissor lift from a lower retracted position. The double lever joint according to the invention is composed of a first and a second lever element connected to each other. Preferably, the first and the second lever element are pivotably supported about an axle in their connection region. Herein, an extendable portion of the linear actuator, for example the piston head of a hydraulic or pneumatic cylinder, can be connected to this pivot axle. Furthermore, advantageously, a scissor arm is pivotably connected to the first lever element at a first location and is pivotably connected to the second lever element at a second location. The scissor lift can include a further pair of scissor arms crossing each other which is also connected to the double lever joint. Here, the first pair of scissor arms can be located on the left and the second pair of scissor arms can be located on the right side of the double lever joint. In other words, the double lever joint can be located between the two pairs of scissor arms and there be hingedly connected to them.

Furthermore, extension of the linear actuator from a lower rest position into a first extension position can produce set-up of the second lever element relative to the extension direction of the linear actuator and relative to the longitudinal axis of the scissor arm. This arrangement of the first and the second lever element allows a particularly efficient coupling of the lifting movement of the linear actuator to a scissor arm with an advantageous work angle during the lifting phase of the scissor lift from a lower rest state.

Furthermore, the pivot axle, i.e. the common pivot axle of the first and the second lever element of the double lever joint, can be supported in an elongated hole of the first lever element, wherein the extension of the linear actuator into the first extension position displaces the pivot axle along the elongated hole. The guidance of the pivot axle by the elongated hole of the first lever element allows a particularly low-noise, predetermined erection of the lever element. Moreover, the end region of the elongated hole constitutes a stop point, whereby a separate stop plate attached to the scissor arm and known from the prior art can be omitted. If a lever element with elongated hole is used, reaching this stop position of the elongated hole determines reaching the first extension position. The double lever joint with elongated hole further allows an advantageous tensile stress of the component during the set-up operation.

For increasing the support stability and reduction of material stresses, the first and/or the second lever element can be composed of each two parallel disposed lever plates, which are each disposed pivotable and parallel via joint bolts. For example, the two lever plates of the first lever element can each be hinged to a scissor arm in one of their end regions, while they are connected to the extendable piston head of the lifting cylinder on opposing sides, respectively, in a second end region. For example, the two lever plates of the second lever element can be disposed parallel and equidistant to each other via a joint bolt and be hinged to a scissor arm of the scissor lift via this joint bolt, while they are pivotably supported with an end region of the lever plates of the first lever element at the same time.

For guiding the rotating movement of the second lever element during the set-up operation, the second lever element can be detachably supported movable on a guiding element in a second end region, wherein the extension of the linear actuator into the first extension position produces an opposed movement of the second end region of the second lever element.

This guiding element can be a guiding plate attached to the scissor arm. For realizing a material protecting, low-noise and controlled movement of the second lever element during the set-up operation, the second lever element can be slidingly supported on the guiding plate via a push element hinged to the second end region.

If the second lever element is composed of two parallel lever plates, advantageously, two push elements can be pivotably attached to each end region of the lever plates. The guiding plate can have a central recess for receiving the second end region of the second lever element during extension of the linear actuator into the first extension position.

Furthermore, a push element can be pivotably attached on the second end region between the lever plates, wherein the guiding plate has a central recess for receiving the push element during extension of the linear actuator into the first extension position.

In order to realize a force flow as linear as possible, the lever plates of the first and the second lever element have the shape of an elongated rectangle with greatly rounded end regions in plan view. Furthermore, the lever plates can have recesses along the longitudinal axis for receiving each one pivot bolt.

Preferably, a scissor lift includes at least one lifting device according to the invention. For example, four lifting devices can be employed for a scissor lift, wherein each two of the scissor arms are associated with a driving surface.

In summary, by the present invention, a lifting device for a scissor lift is allowed, which permits reduction of the lifting force during set-up from a lower retracted position. Therein, the lifting device according to the invention is realized by set-up components to be manufactured in inexpensive manner, to which the double lever joint, the guiding plate and the push elements belong. The components can be realized with high support stability, which at the same time allow a very low-noise erecting operation and ensure a low mechanical loading of the set-up components.

Preferred embodiments and further details of the present invention are described in more detail below with reference to the attached schematic drawings.

Figure 1:
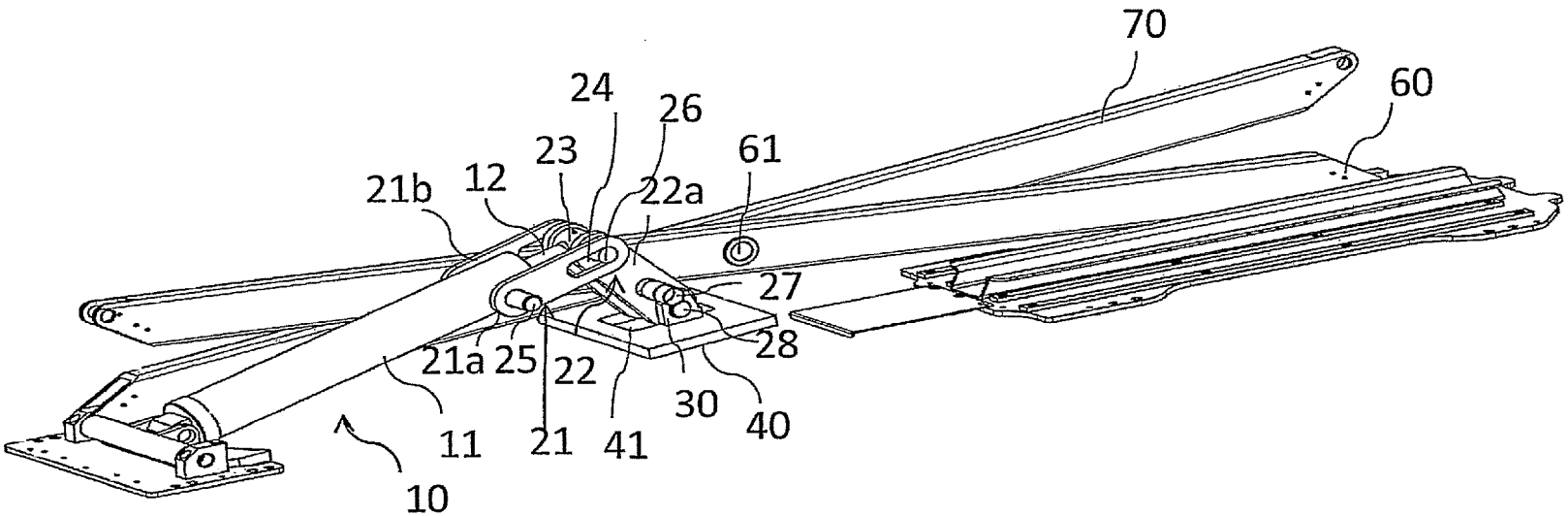
FIG. 1 shows a perspective view of the lifting device according to an embodiment of the present invention.

FIG. 1 shows a perspective view of the lifting device of a scissor lift for raising motor vehicles (not illustrated) according to an embodiment of the present invention. For clarifying the principle of the lifting device according to the invention, the remaining components of a scissor lift such as driving rails, contact areas, operating units etc., which are designed in usual manner, have not been further illustrated. The lifting device according to the invention is also suitable for the employment of double scissor lifts.

As shown in FIG. 1, the lifting device includes two scissor arms 60, 70 crossing each other for lifting a scissor lift. The two scissor arms 60, 70 are connected to each other via a pivot joint 61. A linear actuator 10 in the form of a hydraulic cylinder with a non-extendable region 11 and an extendable portion 12 (cylinder piston rod) serves as a drive assembly. As the head of the lifting cylinder piston rod 12, on the end side, a radial slide bearing is attached, in which a joint bolt 26 is located, which each protrudes from the slide bearing on the end side. The joint bolt 23 constitutes a central pivot axle 23 of the double lever joint 20.

The double lever joint 20 includes a first 21 and a second 22 lever element, by means of which the lifting movement of the linear actuator 10 is coupled to the scissor arm 60. For improving the unfavorable work angle of the linear actuator 10 in lifting the lowered scissor arms, the two lever elements of the double lever joint can erect or tilt at the beginning of the lifting operation in the lowered state compared to the longitudinal axis of both the linear actuator 10 and the scissor arm 60, which is described in more detail below based on FIGS. 4A-4C. Thereby, more beneficial lever attack ratios and lever geometries arise, which results in reduction of the lifting force to be applied by the linear actuator.

To this, the first lever element 21 is pivotably connected to the scissor arm 60 via a joint bolt 25, wherein a slide bush in the scissor arm 60 receives the joint bolt 25. Besides the rear scissor arms (60, 70) shown in FIG. 1, the lifting device further includes a second, front pair of scissor arms crossing each other (not shown), which are parallel to the first pair of scissor arms (60, 70). For clarifying the construction and the operating principle of the lifting device according to the invention, this second pair of scissor arms was not illustrated in the figures. The first lever element 21 is composed of two identically constructed lever plates 21*a*, 21*b*. The rear plate 21*b* is pivotably connected to the inner scissor arm 60 of the rear arm pair via the bolt 25, while the front plate 21*a* is also pivotably connected to the inner arm of the front arm pair (not shown) with a bolt 25.

Figure 2A:
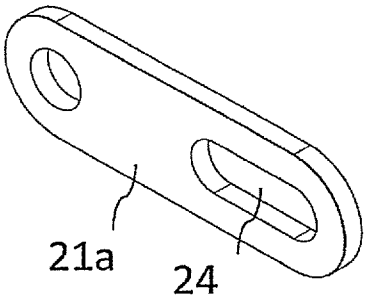
FIG. 2A shows a perspective view of a lever plate of the first lever element.

Such a lever plate 21*a* is shown in FIG. 2A. The lever plate 21*a* has the shape of an elongated rectangle with greatly rounded end regions in the plan view. The lever plate 21*a* has a circular bore at an end, the center point of which is on the longitudinal axis of the plate 21*a*. By means of this bore, the plate is attached to the inner one of the crossing scissor arms via the joint bolt 25. On the other side, the lever plate 21*a* has an elongated hole 24, the longitudinal axis of which is situated on the longitudinal axis of the lever plate 21*a*.

As shown in FIG. 1, the extendable portion 12 of the lifting assembly 10 has a slide bearing for receiving the joint bolt 26 in its head region, wherein the two lever plates 21*a*, 21*b* of the first lever element 21 and the two lever plates 22*a*, 22*b* of the second lever element 22 are additionally pivotably supported at the two outer ends of the joint bolt 26 protruding from the slide bearing. The elongated hole 24 of the lever plates 21*a*, 21*b* serves for receiving this joint bolt 26, wherein a protruding end of the joint bolt 26 is each slidingly supported in the elongated hole 24 of the plate 21*a* with clearance fit, while the opposing end of the joint bolt 26 is supported in the elongated hole 24 of the plate 21*b*. Thereby, extension of the portion 12 of the linear actuator 10 displaces the bolt 26 along the elongated hole 24 until this bolt hits the end of the elongated hole 24.

The lever plates 22*a*, 22*b* of the second lever element 22 are disposed parallel to each other via the two joint bolts 26 and 27. Herein, the lever plates 22*a*, 22*b* are connected to the scissor arm 60 via the joint bolt 27. On the side of the lever plate 22*a*, there is the inner scissor arm of the second arm pair (not shown), to which the plate 22*a* is connected via the bolt 27. At the lower end of the lever plates 22*a*, 22*b*, push elements 30 are attached to the two outer sides of the lever plates 22*a*, 22*b* by means of the joint bolt 28.

Figure 2B:
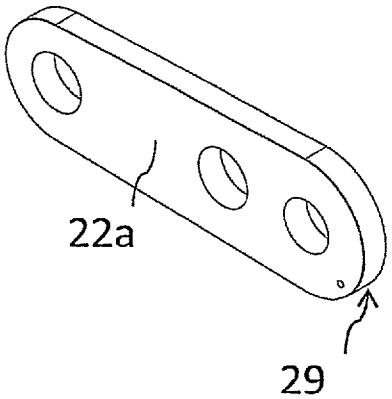
FIG. 2B shows a perspective view of a lever plate of the second lever element.

The lever plate 22*a* of the second lever element 22, which is identically constructed to the lever plate 22*b*, is described in more detail in FIG. 2B. For receiving the bolts 26, 27, 28, the lever plates 22*a*, 22*b* have three circular bores along the longitudinal axis of the plates. The lever plates 22*a*, 22*b* of the thickness of 20 mm are for example manufactured from steel S355, which is characterized by high yield strength, welding qualification and brittle fracture safety. The contour of the lever can for example be cut out of a plate by laser cutting.

Compared to the spreading levers known from the prior art up to now, the lever elements of the double lever joint can be simpler and more inexpensively manufactured due to the simple milling contour. Moreover, the shapes of the lever plates shown in FIG. 2A and FIG. 2B allows a beneficial force flow as linear as possible such that a comparatively low stress value occurs in typical application scenarios and thereby results in decreased mechanical loading.

Due to the perspective illustration in FIG. 1, only the front one of the two push elements 30 is visible. The push element 30 corresponds to a slide block, which rests on the guiding plate 40. During the set-up operation, the push element 30 displaces on the guiding plate 40. For optimum sliding, a lubricating film is applied between these two components.

Figure 2C:
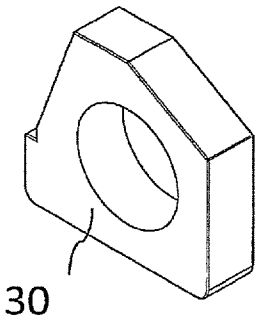
FIG. 2C shows a perspective view of the push element.

The push element 30 is illustrated in more detail in FIG. 2C. The push element 30 has rounded corners, which counteract the abrasion of the lubricating film on the resting surface in the two directions of travel. In addition, these roundings have the advantage that small torsions during lowering the lift do not cause any damage on the surface of the plate 40. However, the push element 30 additionally has to be secured against torsion by e.g. a spring or a pin. In an embodiment, two push elements 30 per lifting device and four push elements 30 per scissor lift are installed. For ensuring the minimum distance to all of the adjacent components, the push element 30 has the upper chamfers shown in FIG. 2C. The greatest stresses in this component occur shortly before the lever reaches the stop. The compressive stress is substantially ca. 270 $N/mm^2$ at this moment. For manufacturing the push element 30, a material with good sliding characteristics and high wear resistance is used, for example CuSn8P. A further, more inexpensive possibility is the use of an abrasion-resistant plastic with good sliding characteristics, for example polyamide (PA) with glass fiber reinforcement.

Figure 2D:
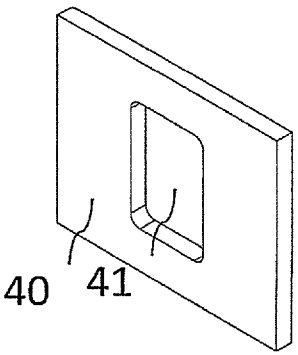
FIG. 2D shows a perspective view of the guiding plate.

The guiding plate 40 shown in FIG. 2D has a central recess 41 for receiving the second end region 29 of the second lever element 22. This allows movement of the lever plates 22*a*, 22*b* during the set-up operation in the region 41, without falling below the required minimum distance to the other components. Hereby, more stable design of the lever plates 22*a*, 22*b* of the second lever element 22 is allowed. The guiding plate 40 sized 330 mm×270 mm×25 mm in the illustrated embodiment is welded to the scissor arm 70 on each side of the scissor lift. The push elements 30 displace on this plate 40. The left and right side of the guiding plate 40 are welded to the scissor arm with a lap joint. By the positioning of the push elements 30 on the sides, the moment on the sides is lower than with positioning of only one push element 30 in the center of the plate 40. In order to achieve a good stress distribution in the corners, they are rounded with large radii.

Figure 3:
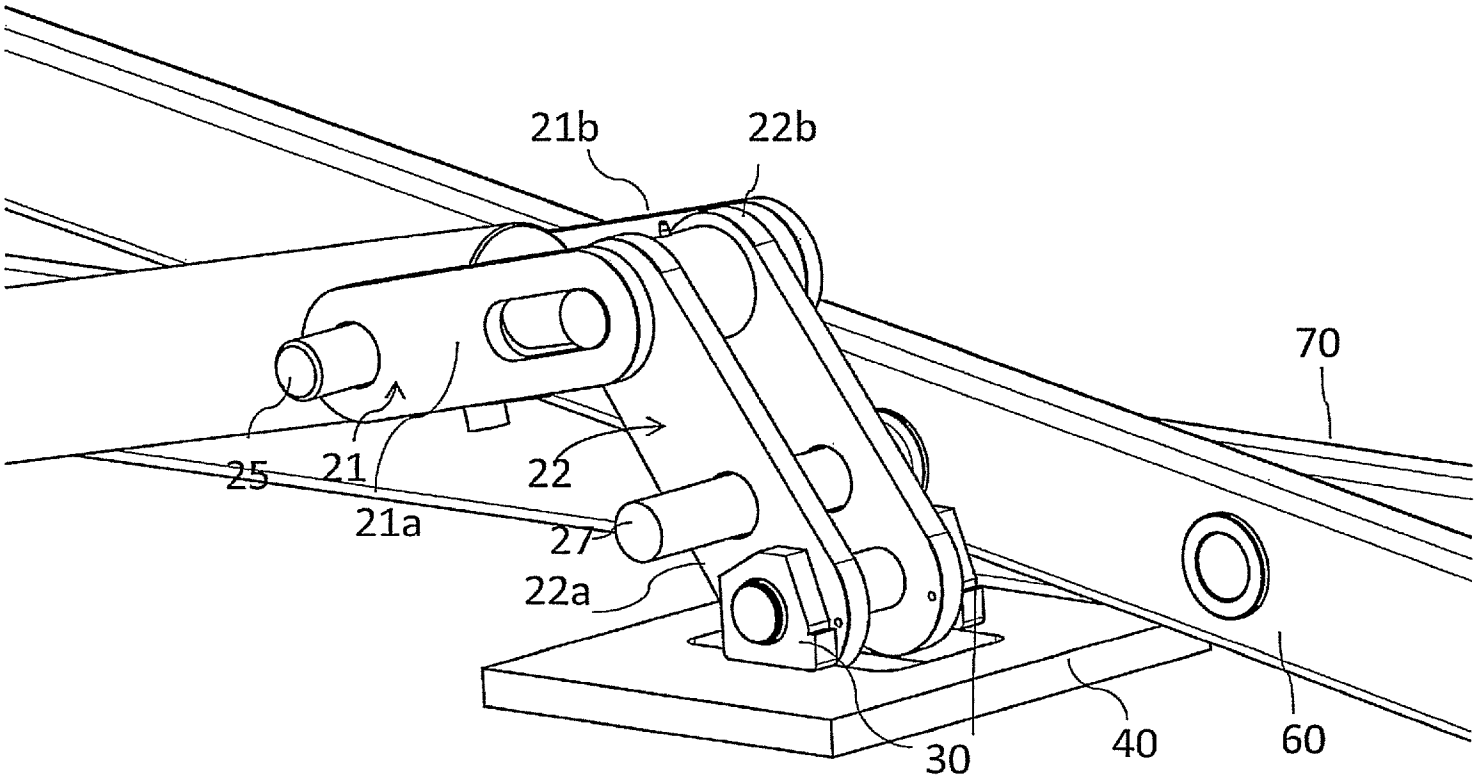
FIG. 3 shows an enlarged perspective view of the lifting device according to an embodiment of the present invention.

The just described elements of the lifting device are again illustrated in the enlarged perspective view of FIG. 3.

In a further not illustrated embodiment, the second lever element 22 is composed of a lever plate, wherein the cylinder head 12 of the linear actuator 10 is formed bifurcated for pivoted support of the second lever plate. In the end region of the second lever element 22, on opposing sides of the lever plate of the second lever element, each two push elements 30 are attached for sliding support on the guiding plate 40.

Figures 4A, 4B, 4C:
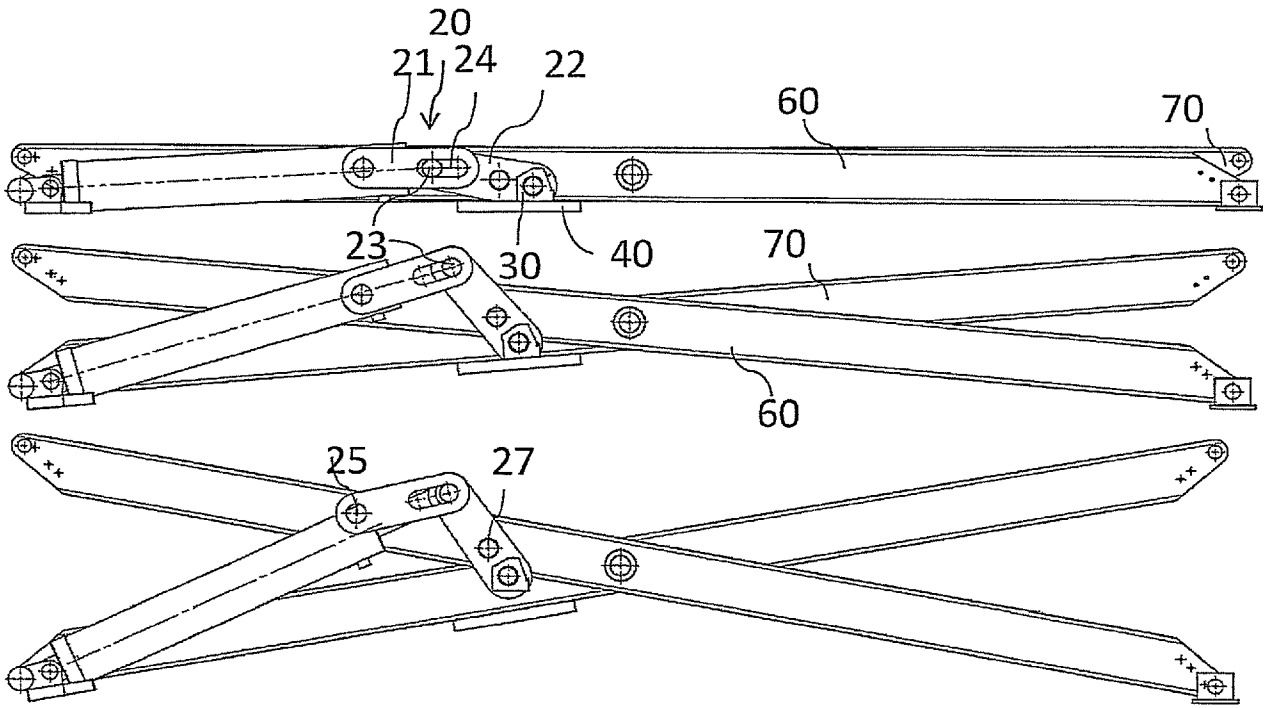
FIG. 4A shows a side view of the lifting device in the lowered state.
FIG. 4B shows a side view of the lifting device in a first extension position.
FIG. 4C shows a side view of the lifting device in a second extension position according to an embodiment of the present invention.

With reference to FIG. 4A to 4C, now, the function of the set-up mechanism is to be described in more detail based on three different lifting positions.

In FIG. 4A, the scissor arms 60, 70 and thereby the scissor lift is in a lowered lower position, which is intended for drive-on of a motor vehicle. In this position, the linear actuator 10 is in a retracted state; the longitudinal axis of the linear actuator has only a very low inclination of ca. 3° to the horizontal. The axle 23, which connects the lifting piston 12, the first lever element 21 and the second lever element 22 via the bolt 26, is located in a left end region of the elongated hole 24 shown in the drawing. The double lever joint 20 also has a nearly stretched, horizontal orientation, wherein the first 21 and the second 22 lever element form an angle of approximately 180° to each other.

FIG. 4B shows the lifting device after the lifting piston 12 of the linear actuator 10 is extended up to a first extension position. Upon extending into this first extension position, the extendable portion 12 displaces the bolt 26 along the elongated hole 24 up to the stop at the right end of the elongated hole 24. Therein, the second lever element 22 reaches a statically determined position upon reaching the stop at the end of the elongated hole 24. In this first extension position, the longitudinal axis of the linear actuator has an inclination of ca. 15° to 20° to the horizontal.

The extension movement of the linear actuator produces a torque on the second lever element 22 of the double lever joint 20 about the rotational axis of the joint bolt 27 and results in a rotating movement and erection of the second lever element 22. Therein, the lower end of the second lever element 22 slides along the guiding plate 40 with the push elements 30 in the direction of the longitudinal axis of the linear actuator 10 opposite to the extension movement of the portion 12 of the linear actuator 10. In other words, the two lever elements of the double lever joint are set up or tilted compared to the longitudinal axis by the extension of the linear actuator into the first extension position with respect to the longitudinal axis both of the linear actuator 10 and the scissor arm 60. This set-up results in spreading apart of the scissor arms 60, 70, wherein the double lever joint introduces a vertical force component applied by the lifting cylinder, which is passed into the bolt 26 into the second lever element via the piston rod 12, via the bolt 27 to the scissor arm 60. Therein, the erection of the second lever element results in an advantageous work angle for applying a lifting force, thereby decreasing the lifting force to be applied by the linear actuator. The second front pair of scissor arms not shown in the figures, is spread apart just as the scissor arms 60, 70.

FIG. 4C shows a second extension position upon continuation of the lifting movement after reaching the first extension position. After the stop position of the slide bolt 26 at the end of the elongated hole 24 is reached, the push elements 30 lift off from the guiding plate 40 under the effect of the linear actuator. Therein, the guiding plate is welded to the scissor arm 70.

It is understood that the individual features of the invention are not restricted to the described combinations of features within the scope of the presented embodiments and can also be employed in other combinations depending on preset device parameters. The specified exemplary values for the component sizes, work angles, material stresses etc. are only exemplary and are in no way to be construed in restricting manner, since these values depend on the definite design and dimensioning of the scissor lift.

The invention claimed is:

1. A lifting device for scissor lifts, comprising
at least two scissor arms crossing each other;
a linear actuator for lifting the scissor arms; and
a double lever joint pivotably supported on a first one of the scissor arms, wherein
the double lever joint couples lifting movement of the linear actuator to at least one of the scissor arms,
a first lever element and a second lever element of the double lever joint are pivotably supported about an axle and an extendable portion of the linear actuator is directly connected to the axle, and
the first one of the scissor arms is pivotably connected to the first lever element at a first location and is pivotably connected to the second lever element at a second location.

2. The lifting device according to claim 1, wherein extension of the linear actuator from a lower rest position into a first extension position produces set-up of the second lever element relative to an extension direction of the linear actuator and relative to a longitudinal axis of the scissor arm.

3. The lifting device according to claim 2, wherein the axle is supported in an elongated hole of the first lever element, wherein the extension of the linear actuator into the first extension position displaces the axle along the elongated hole.

4. The lifting device according to claim 1, wherein the first lever element and the second lever element each include two parallel disposed lever plates, which are each pivotably and parallel disposed via joint bolts.

5. The lifting device according to claim 4, wherein the second lever element is detachably supported movable on a guiding element in a second end region, wherein the extension of the linear actuator into the first extension position produces an opposite movement of the second end region of the second lever element.

6. The lifting device according to claim 5, wherein the guiding element is a guiding plate attached to the first one of the scissor arms, and the second lever element is slidingly supported on the guiding plate via a push element hinged to the second end region.

7. The lifting device according to claim 6, wherein a push element is pivotably attached to each of the lever plates in the second end region, and wherein the guiding plate has a central recess for receiving the second end region of the second lever element during the extension of the linear actuator into the first extension position.

8. The lifting device according to claim 6, wherein a push element is pivotably attached in the second end region between the lever plates and wherein the guiding plate has a central recess for receiving the push element during the extension of the linear actuator into the first extension position.

9. The lifting device according to claim 4, wherein the lever plates have a shape of an elongated rectangle with greatly rounded end regions in a plan view, with recesses along a longitudinal axis for receiving one pivot bolt each.

10. A scissor lift comprising at least one lifting device according to claim 1, wherein the scissor lift comprises two pairs of scissor arms crossing each other.

* * * * *